US006651349B2

(12) United States Patent
Coplon et al.

(10) Patent No.: US 6,651,349 B2
(45) Date of Patent: Nov. 25, 2003

(54) OUTER-SOLE SHOE FITTING GUIDE

(75) Inventors: H. Kevin Coplon, Bandung (ID); Will St. Onge, Bangdung (ID)

(73) Assignee: Ion Beam Applications S.A., Louvain-la-Neuve (BE)

( * ) Notice: Subject to any disclaimer, the term of this patent is extended or adjusted under 35 U.S.C. 154(b) by 0 days.

(21) Appl. No.: 10/086,317

(22) Filed: Mar. 1, 2002

(65) Prior Publication Data

US 2002/0092182 A1 Jul. 18, 2002

Related U.S. Application Data

(60) Division of application No. 09/644,919, filed on Aug. 23, 2000, now Pat. No. 6,415,530, which is a continuation-in-part of application No. 09/466,327, filed on Dec. 17, 1999, now abandoned.

(51) Int. Cl.[7] ..... A61B 5/107
(52) U.S. Cl. ..... 33/3 A; 33/515; 36/8.4
(58) Field of Search ..... 33/562, 563, 566, 33/4, 3 R, 5, 6, 3 A, 3 B, 3 C, 512, 515; 36/8.4, 1, 112, 136

(56) References Cited

U.S. PATENT DOCUMENTS 1,469,944 A * 10/1923 Merrill ..... 33/494
1,543,747 A * 6/1925 Brey ..... 281/15.1
2,029,553 A * 2/1936 Bartschi et al. ..... 12/120.5
2,163,661 A * 6/1939 Brown ..... 33/3 A
2,464,451 A * 3/1949 Gardner ..... 36/1
2,593,385 A * 4/1952 Digate ..... 33/3 A
2,835,908 A * 5/1958 Mott ..... 12/142 N
2,860,416 A * 11/1958 Pfund ..... 33/3 A
3,022,577 A * 2/1962 Rockmore ..... 33/3 A
3,359,640 A * 12/1967 Kirkland ..... 33/3 A
4,387,516 A * 6/1983 Laux ..... 36/43
5,014,041 A * 5/1991 Rosen ..... 340/573.1
5,539,677 A * 7/1996 Smith ..... 33/3 R
D466,273 S * 12/2002 Byrd ..... D2/952
2002/0035793 A1 * 3/2002 Byrd ..... 36/8.4

* cited by examiner

*Primary Examiner*—Diego Gutierrez
*Assistant Examiner*—Amy R. Cohen
(74) *Attorney, Agent, or Firm*—Merchant & Gould P.C.

(57) ABSTRACT

The invention relates to a method, system and shoe for determining the fit of a shoe from outside the shoe wherein the shoe has an outsole that has a reference gauge for placing a person's heel and a reference mark indicating how far a person's toes should extend so that the shoe would fit. The system is adaptable so a decal may be used or a separate foot measurement guide such as a hang tag may be attached to a shoe where the visual fit guide depicted on the hang tag corresponds to the size of the shoe to which it is applied. The hang tag may be printed on both sides to correspond to both a left and right foot.

26 Claims, 5 Drawing Sheets

OUTER-SOLE SHOE FITTING GUIDE

RELATED APPLICATION

This application is a divisional of U.S. patent application Ser. No. 09/644,919 filed Aug. 23, 2000 now U.S. Pat. No. 6,415,530, which is a continuation-in-part of U.S. patent application Ser. No. 09/466,327 filed Dec. 17, 1999, abandoned.

BACKGROUND OF THE INVENTION

1. Field of the Invention

The invention relates to a method, system and shoe for determining the fit of a shoe from outside the shoe.

2. Description of Related Art

Many types of shoes are known in the art. Some shoes known in the art provide means for determining whether they fit. However, none of the prior art provides a way to determine whether a shoe will fit from outside the shoe. For example, a person may be in a hurry and not want to take the time to try on a shoe. Also, room to try on a shoe may not be available where the shoe is sold. Also, a shoe may be sold where there is insufficient experienced staff to help a person choose the correct size. In addition, a person buying a shoe for a child may not be able to determine the room within the shoe for growth of a child's foot.

For example, U.S. Pat. No. 5,014,041 to Rosen and U.S. Pat. No. 5,084,988 to Berger disclose shoes that have transparent soles through to the interior of the shoe to show when a foot is outgrowing a shoe. These patents require that a person wear the shoe before being able to determine whether they fit. Additionally, Rosen and Berger suffer from the fact that over time the transparent soles may discolor and get scuffs so that a person could not look through them.

The use of removable insoles or socks with printed length areas which are removable from the inside of the shoe are known in the industry. In addition, U.S. Pat. No. 2,464,571 to Gardner discloses a removable shoe-fit indicator which indicates the fit of the shoe on the child on an insole. To use the indicator in Gardner, a person must put coloring on the removable indicator which will color a child's toes or socks to indicate the fit of the shoe. The interior piece would make the process of making the shoe more expensive, and would impact the comfort of the shoe. The use of coloring makes Gardner messy and inconvenient.

Patterns on the outsole of a shoe are also known. U.S. Pat. No. 4,266,349 to Schmohl discloses a profile pattern on a sole that has a plurality of concentric circles. The profile pattern in Schmohl is irrelevant to the issue of fit; it is used for the absorption and transfer of the forces acting upon the sole.

None of the devices in the above references solve the problem of determining whether a shoe will fit a person's foot without the person trying on the shoe. Furthermore, none of the devices solve the problem of determining the room for growth that a shoe may have without trying on the shoe. Each of the prior art references above require a person to try on a shoe at least once.

SUMMARY OF THE INVENTION

The principal object of the invention is to provide a shoe wherein a person can determine whether a shoe fits without trying it on.

The present invention is a system including a shoe or a shoe with an outsole having a reference gauge at the proximal end of the outsole for placing the heel of a foot; and a first reference mark at the distal end of the outsole corresponding to where the toes of the foot should extend when the heel is placed on the reference gauge to ensure a proper fit of the shoe on the foot. In an alternative embodiment, the reference gauge corresponds to the location of a person's heel inside the shoe. In another embodiment, the reference gauge is substantially u-shaped to correspond to a heel of a foot. In still another embodiment, the reference gauge is substantially an end line.

In another embodiment, the outsole also has a second reference mark distal from the first reference mark corresponding to a clearance distance within the shoe. In yet another embodiment, the outsole also has a third reference mark corresponding to the width within the shoe.

In yet another embodiment, the outsole further comprises a fourth reference mark intermediate to the reference gauge and the first reference mark corresponding to where the ball of the foot should align when the heel is placed in the reference gauge. In yet still another embodiment, the outsole further comprises an outline corresponding with the overall shape within the shoe.

In an alternative embodiment, the reference gauge is permanently affixed to the outsole. In another embodiment, the first reference mark is permanently affixed to the outsole. In another embodiment, the second reference mark is permanently affixed to the outsole. In yet still another embodiment, the third reference mark is permanently affixed to the outsole. In yet still another embodiment, the fourth reference mark is permanently affixed to the outsole. In yet another embodiment, the outline is permanently affixed to the outsole.

In an alternative embodiment, the reference gauge is temporarily affixed to the outsole. In another embodiment, the first reference mark is temporarily affixed to the outsole. In another embodiment, the second reference mark is temporarily affixed to the outsole. In yet still another embodiment, the third reference mark is temporarily affixed to the outsole. In yet still another embodiment, the fourth reference mark is temporarily affixed to the outsole. In yet another embodiment, the outline is temporarily affixed to the outsole. To temporarily affix the above marks, gauge and outline to the outsole, a decal having the combined features can be adhesively applied to the outsole by peeling the decal from an adhesive protective substrate and applying the decal with the features depicted on it to the outsole.

In yet another embodiment, the invention is a method for determining the fit of a shoe from outside the shoe including the steps of providing a shoe having an outsole including a reference gauge at the proximal end of the outsole for placing the heel of a foot and a first reference mark at the distal end of the outsole corresponding to where the toes of the foot should extend when the heel is placed on the reference gauge to ensure a proper fit of the shoe on the foot, placing a heel on a reference gauge located on the proximal end of an outsole of the shoe, placing a foot on the outsole so the heel remains on the reference gauge and the toes extend along the outsole toward the distal end of the outsole and comparing the extension of the toes to a first reference mark on the distal end of the outsole corresponding to where the toes of the foot should extend when the heel is placed on the reference gauge to ensure a proper fit of the shoe on the foot. In still another embodiment, the reference gauge corresponds to the location of a person's heel inside the shoe. In yet another embodiment, the reference gauge is substantially u-shaped to correspond to a heel of a foot. In an alternative embodiment, the reference gauge is substantially an end line.

In still another alternative embodiment, the outsole further comprises a second reference mark distal from the first reference mark corresponding to the clearance distance within the shoe. In yet another embodiment, the outsole further comprises a third reference mark corresponding to the width within the shoe, and the method further comprises the step of comparing the width of the foot with the third reference mark.

In another embodiment, the outsole further includes a fourth reference mark intermediate to the reference gauge and the first reference mark corresponding to where the ball of the foot should align when the heel is placed in the reference gauge; and the method includes the step of placing the ball of the foot on the fourth reference mark. In still another embodiment of the method, the outsole further comprises an outline corresponding to the overall shape within the shoe, and the method further comprises the step of comparing the overall shape of the foot with the outline.

In another embodiment of the method, the reference gauge is permanently affixed to the outsole. In another embodiment, the first reference mark is permanently affixed to the outsole. In still another embodiment, the second reference mark is permanently affixed to the outsole. In yet still another embodiment, the third reference mark is permanently affixed to the outsole. In yet still another embodiment, the fourth reference mark is permanently affixed to the outsole. In another embodiment, the outline is permanently affixed to the outsole.

In another embodiment of the method, the reference gauge is temporarily affixed to the outsole. In another embodiment, the first reference mark is temporarily affixed to the outsole. In still another embodiment, the second reference mark is temporarily affixed to the outsole. In yet still another embodiment, the third reference mark is temporarily affixed to the outsole. In yet still another embodiment, the fourth reference mark is temporarily affixed to the outsole. In another embodiment, the outline is temporarily affixed to the outsole.

In still another embodiment, the invention provides a shoe including an outsole having a reference gauge permanently affixed at the proximal end of the outsole for placing the heel of a foot, wherein the reference gauge is substantially u-shaped to correspond to a heel of a foot and the location of the reference gauge on the outsole corresponds to the location of a person's heel inside the shoe; a first reference mark permanently affixed at the distal end of the outsole corresponding to where the toes of the foot should extend when the heel is placed on the reference gauge to ensure a proper fit of the shoe on the foot; a second reference mark permanently affixed on the outsole distal from the first reference mark corresponding to a clearance distance within the shoe; a third reference mark permanently affixed on the outsole corresponding to the width within the shoe; a fourth reference mark permanently affixed on the outsole intermediate to the reference gauge and the first reference mark corresponding to where the ball of the foot should align when the heel is placed in the reference gauge; and an outline permanently affixed to the outsole corresponding with the overall shape within the shoe.

In an embodiment of the invention mentioned above regarding the temporary affixation of the invention to the outsole of a shoe, the above described features may be incorporated onto a decal which is removably or peelably attached to a substrate. A shoe retailer or manufacturer can then apply a decal corresponding to a respective shoe size to one or both of the shoe outsoles, depending on whether the decal is for a left or right shoe. Consumers can then match a foot to the outsole with the decal applied to determine if the shoe size is proper without having to actually try on the shoe first.

In another embodiment of the invention, the features are incorporated on a tag which acts as a visual shoe fit guide that can come with the shoe in a shoe box and be preferably attached to one of the shoes so that when the shoe is removed from the shoe box in a retail store, the tag is available for a quick reference check to determine if the shoe size is correct. Preferably, the tag can be printed on both sides wherein one side will correspond to a left foot and the opposite side will correspondent to the right foot.

All of these embodiments described herein, including the method of determining the proper fit of a shoe will allow consumers to serve themselves without reliance on shoe sales personnel retrieving a shoe size gauge. These shoe size gauges may be available in some stores for consumers to use, but in most cases, they are not. Even when made available, they are often difficult to use due to the complexity of reference marks indicating both width and sizes for each foot. When read properly, they are accurate but more often than not in discount stores, consumers generally have to fit themselves. Therefore, the present invention provides a useful and simple means for checking proper shoe size without having to wait for a sales person to attend to the consumer.

BRIEF DESCRIPTION OF THE DRAWINGS

For a fuller understanding of the nature and objects of the invention, reference should be made to the following detailed description, taken in connection with the accompanying drawings, in which.

These drawings are merely examples and are not intended to limit the invention in any way.

DETAILED DESCRIPTION OF THE INVENTION

Figure 1:
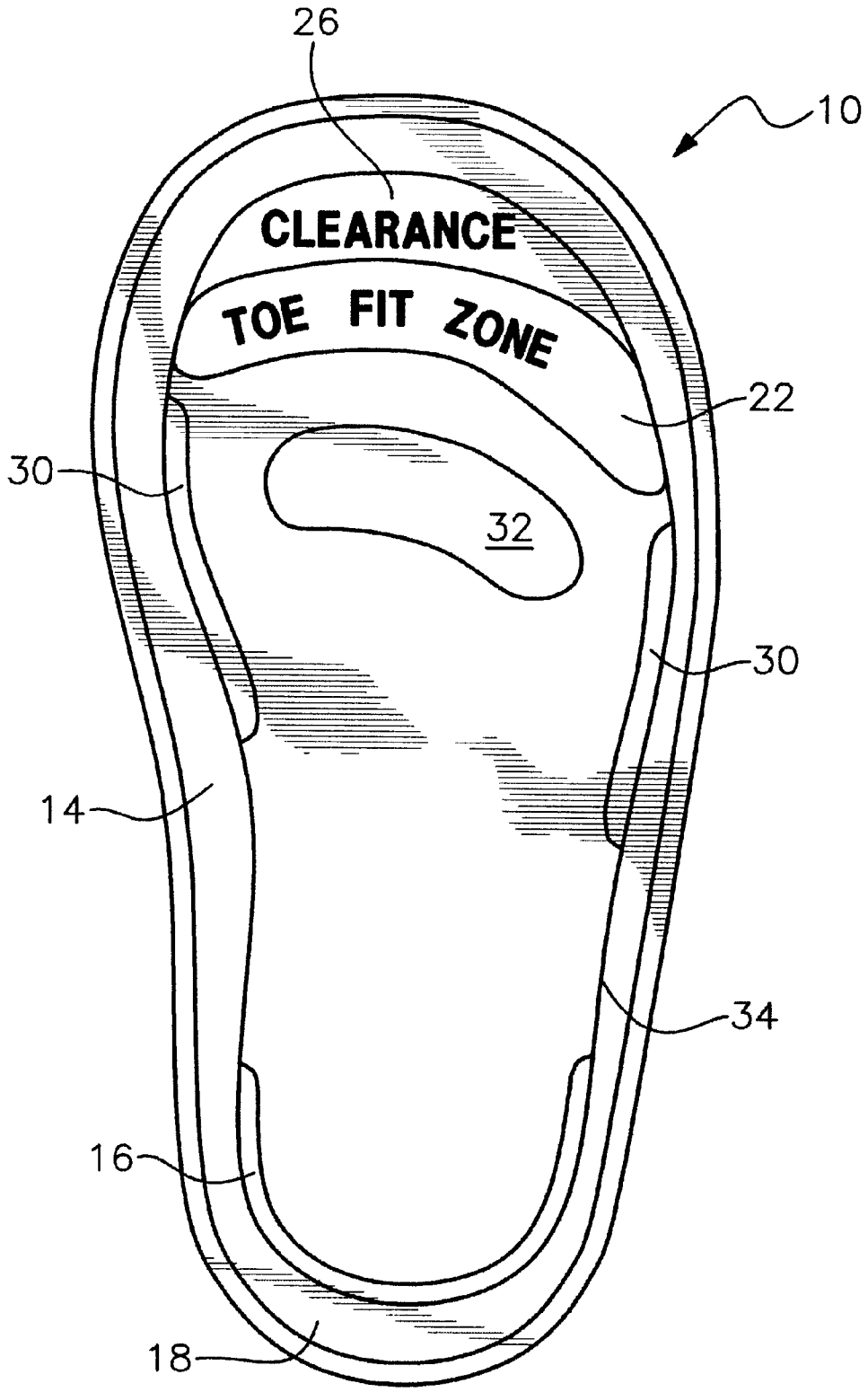
FIG. 1 is a perspective view of the present invention.
Figure 2:
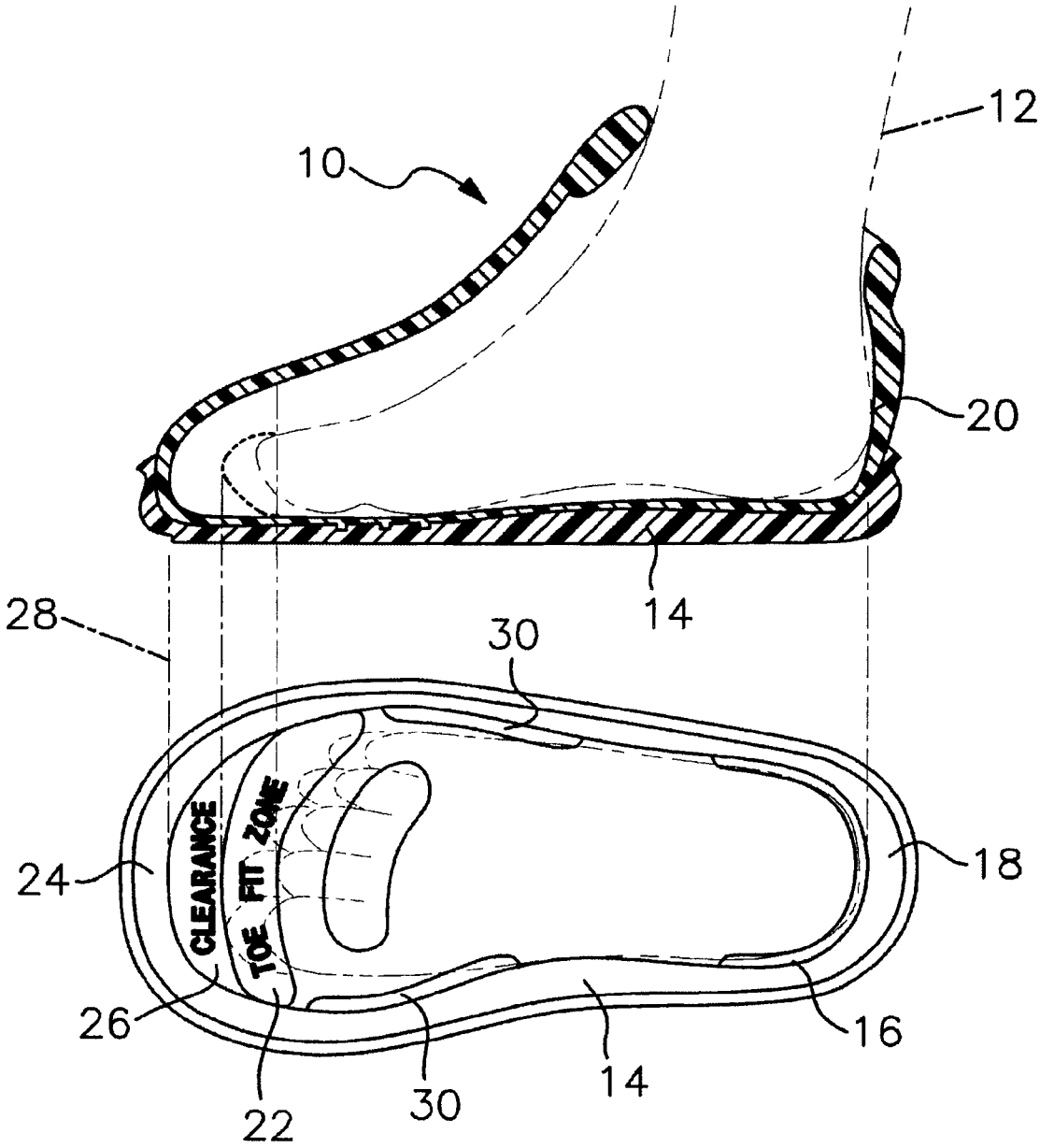
FIG. 2 is a perspective view of the present invention when a foot is inside a shoe embodying the present invention.

Referring now to the drawings, in particular FIG. 1, the invention which is a shoe enabling determination of fit from outside of the shoe, is depicted generally as 10. The shoe 10, used to protect a foot 12, may be made of any of the materials known in the art, including leather and rubber. The outside of the shoe 10 comprises an outsole 14 or bottom. The outsole 14 also can be made of many materials known in the art, including rubber and leather. The outsole 14 of the shoe 10 includes a reference gauge 16 at the proximal end 18 of the outsole 14 for the placing of the heel 20 of the foot 12 as generally shown in FIGS. 1 and 2. The reference gauge 16 is shaped to correspond with a person's heel 20. The reference gauge 16 may comprise of one or more marks and may be substantially u-shaped or substantially an end line or comprise of another shape or other shapes. The preferred embodiment is a substantially u-shaped reference gauge 16, as shown in FIGS. 1 and 2. The reference gauge 16 may be permanently or temporarily affixed to the outsole 14. The reference gauge 16 may be placed on the outsole 14 by being molded into, painted, printed or inscribed into the outsole 14. As an alternative embodiment, the reference gauge 16 may be printed on plastic or paper with an adhesive backing and attached to the outsole 14. Other means of placing the reference gauge 16 on the outsole 14 are known in the art. In an alternative embodiment, the location of the reference gauge 16 corresponds with heel 20 placement inside the shoe 10.

In addition, the outsole 14 comprises a first reference mark 22 at the distal end 24 of the outsole, corresponding to where the toes of the foot 12 should extend when the heel 20 is placed on the reference gauge 16 to ensure a proper fit of the shoe 10 on the foot 12. The first reference mark 22 may be a bar, a line, a series of lines or an area indicating a range within which the toes of the foot 12 may extend from the reference gauge 16 so that the shoe 10 would still fit. Additional means for providing a first reference mark 22 corresponding to where the toes should align for proper fit are also known in the art.

Alternately, the outsole 14 may further comprise a second reference mark 26. The second reference mark corresponds with the room left within the shoe 10 from the distal end of the first reference mark 22. The second reference mark 26 thus may operate as a warning bar indicating the maximum recommended allowance for toe room and growth. The second reference mark may measure a clearance distance for the foot 12 distally up to the tip 28 of the inside of the shoe 10, or vamp. However, the measured clearance distance may also be to the end of the sole part inside the shoe 10, or any other known point for measuring clearance distance for the foot 12.

The first reference mark 22 may be placed permanently or temporarily on the outsole 14. The first reference mark 22 may be molded into, painted, printed or inscribed into the outsole 14. As an alternative embodiment, the first reference mark 22 may be printed on plastic or paper with an adhesive backing and attached to the outsole 14. Other means of placing the first reference mark 22 on the outsole 14, permanently and temporarily, are known in the art.

Similarly, the second reference mark 26 may be placed permanently or temporarily on the outsole 14. The second reference mark 26 may be molded into, painted, printed or inscribed into the outsole 14. As an alternative embodiment, the second reference mark 26 may be printed on plastic or paper with an adhesive backing and attached to the outsole 14. Other means of placing the second reference mark 26 on the outsole 14, permanently and temporarily, are known in the art.

Figure 3:
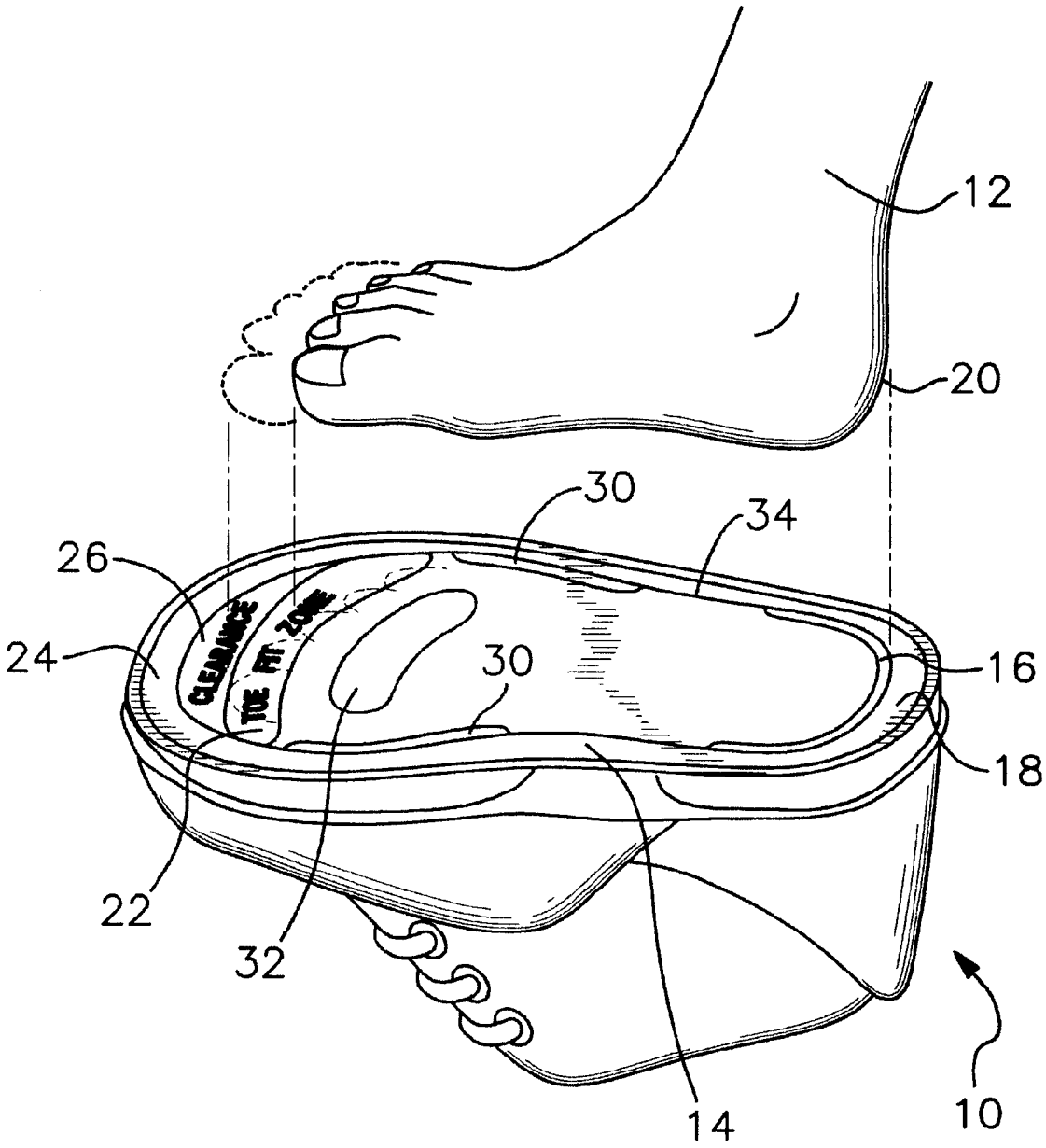
FIG. 3 is a perspective view of the invention in use.

Alternatively, the outsole may comprise a third reference mark 30 corresponding with the width of the inside of the shoe 10. FIGS. 1–3 show the third reference mark 30 as intermediate between the reference gauge 16 and the first reference mark 22. However, other configurations for the third reference mark 30 are also contemplated. Furthermore, FIGS. 1–3 show the third reference mark 30 as two marks. However, the third reference mark 30 may also be indicated by a single area, outline or other means for describing the width within the shoe on the outsole 14.

The third reference mark 30 may be placed permanently or temporarily on the outsole 14. The third reference mark 30 may be molded into, painted, printed or inscribed into the outsole 14. As an alternative embodiment, the third reference mark 30 may be printed on plastic or paper with an adhesive backing and attached to the outsole 14. Other means of placing the third reference mark 30 on the outsole 14, permanently and temporarily, are known in the art.

Alternatively, the outsole 14 may also comprise a fourth reference mark 32 intermediate to the reference gauge 16 and the first reference mark 22. The fourth reference mark 32 corresponds to where the ball of the foot 12 should align when the heel 20 is in the reference gauge 16 to ensure a proper measurement of the toes against the first reference mark 22. The fourth reference mark 32 may be an outline or an area indicating the proper placement for the ball of the foot 12. The fourth reference mark 32 may also be molded into, painted, printed or inscribed into the outsole 14. As with the first reference mark 22, the fourth reference mark 32 may also be printed on plastic or paper with an adhesive backing and attached to the outsole 14. Other means of placing the fourth reference mark 32 on the outsole 14, permanently and temporarily, are known in the art.

As another alternative embodiment, the outsole 14 may also comprise an outline 34 corresponding with the overall shape within the shoe 10. The outline 34 may also be molded into, painted, printed or inscribed into the outsole 14. As above, the outline 34 may be printed on plastic or paper with an adhesive backing and attached to the outsole 14. Additional means of placing the outline 34 on the outsole 14, permanently and temporarily, are known in the art.

The current invention contemplates that the reference gauge 16, first reference mark 22, second reference mark 26, third reference mark 30, fourth reference mark 32 and the outline 34 may be placed on the outsole 14 in any combination. Furthermore, the means for placing the applicable reference gauge 16, first reference mark 22, second reference mark 26, third reference mark 30, fourth reference mark 32 or outline 34, permanently or temporarily, may be different from one another or the same.

Figure 4:
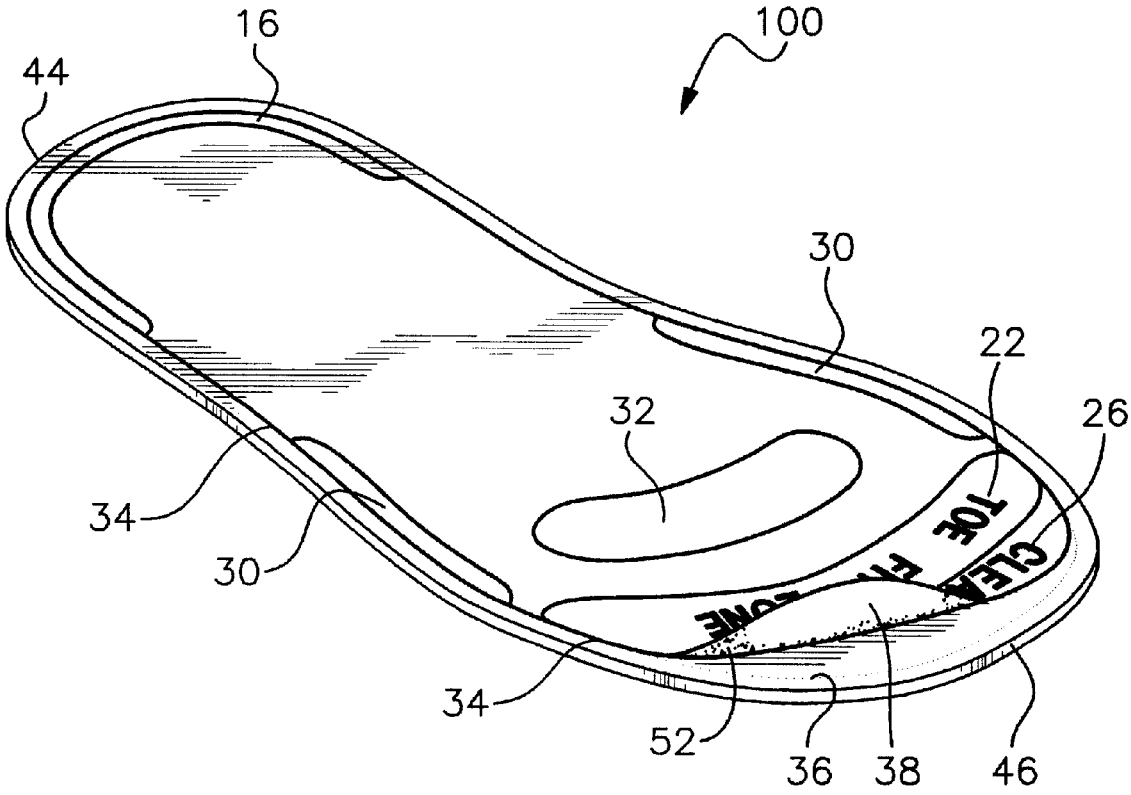
FIG. 4 depicts another embodiment of a decal with the visual foot size guide imprinted thereon.

To provide an example of the invention as used, a person seeks to buy a shoe 10 incorporating the present invention. The person places a foot 12 on the outsole 14 of the shoe, aligning the heel 20 with the reference gauge 16. If the outsole 14 is so equipped, the person may place the ball of the foot 12 where indicated on the outsole 14 by the second reference mark 26. After the person's foot 12 is properly aligned, the person may quickly determine whether that person's toes extend past an area described by the first reference mark 22. If the toes extend beyond the area described by the first reference mark 22, the shoe 10 will be too small. Similarly, if the person's toes do not extend to the area described by the first reference mark 22 the shoe 10 will be too large. If the gauge 16 and applicable reference marks are printed on a thin plastic such as a decal, as generally depicted as 100 in FIG. 4, which is peeled from a substrate 36 to which the decal 38 is removably attached, and subsequently attached to the outsole 14 with the detachable adhesive 52 applied to one side of the decal 38, the person may remove the decal 38 after purchasing the shoes if the person wishes. FIG. 4 depicts each of the aforementioned features that may be incorporated on the outsole 14 wherein the features are arranged between the proximal end 44 of the decal 38 and the distal end 46 of the decal 38.

Figure 5:
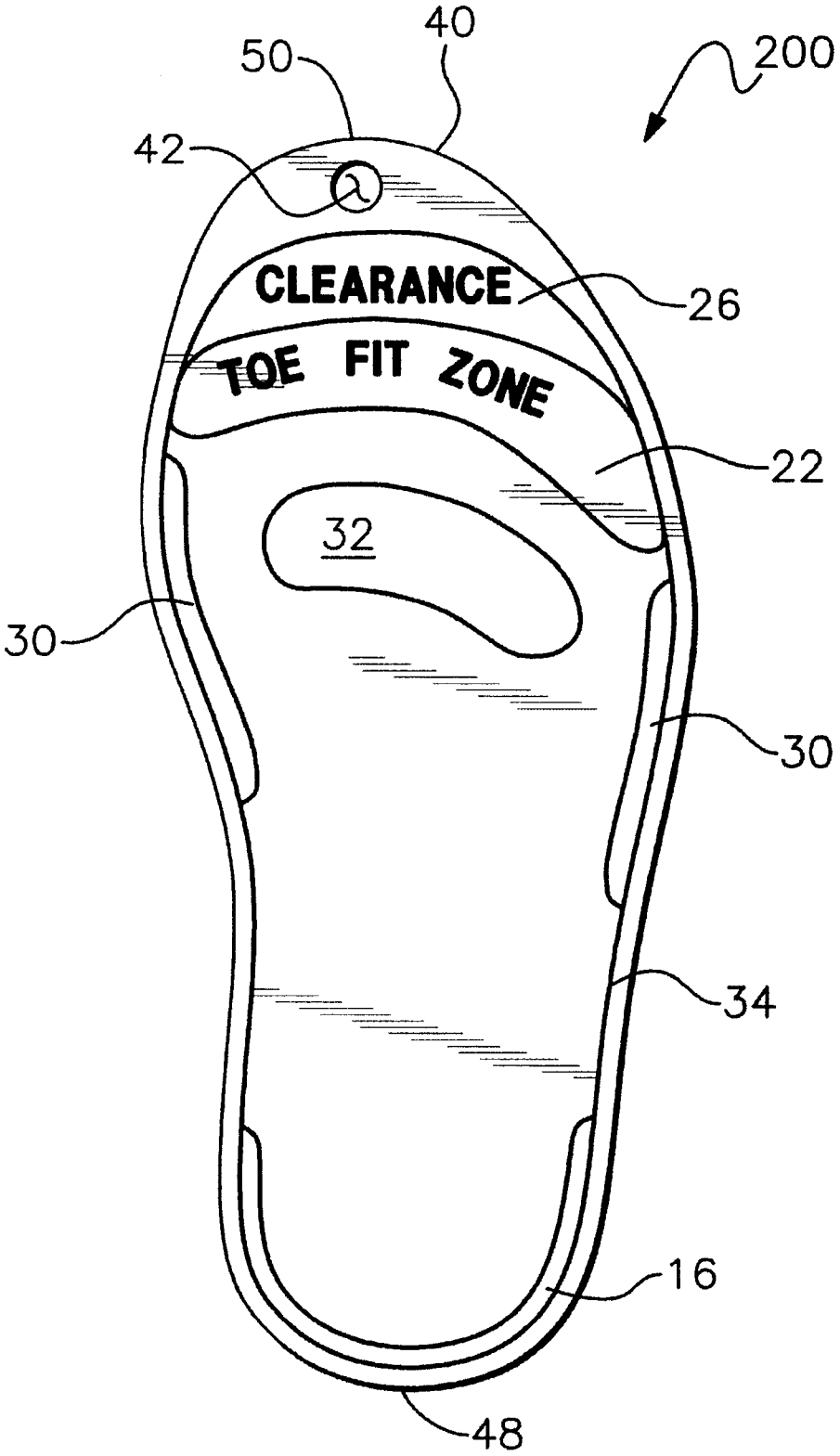
FIG. 5 depicts another embodiment a tag with the visual shoe fit guide imprinted thereon.

FIG. 5 depicts another embodiment which is generally depicted as 200. This embodiment is a tag or hang tag 40, wherein each or any combination of the aforementioned features are printed on at least one side of the tag 40 and arranged between the tag's proximal end 48 and its distal end 60. The tag is preferably formed in the shape of a shoe outsole 14, although it need not be. Preferably, the imprinted is done on both sides of the tag 40 so that one side represents a left foot and the opposite side represents a right foot. Both sides are not shown in the drawings as FIG. 5 which currently depicts a right foot, when flipped over, would represent a left foot. The tag 40 may be inserted in a shoe box and represent a size corresponding to the size of the shoes included in the shoe box. Preferably so the tag 40 is not lost, hole 42 should be included so the tag can be temporarily attached to one of the shoes such as an eyelet or a shoestring. After the shoes are purchased, the consumer can then remove the tag 40 prior to use of the shoes. Of course, if the manufacturer desires, a separate tag 40 may be attached to each of a left and right shoe, wherein the tag 40 representing a left shoe is attached to the left shoe and a tag 40 representing a right shoe is attached to the right shoe. The tag 40 is typically made from paper stock material similar to that used for most tags attached on clothing and accessories.

As seen from the foregoing description, the present invention satisfies a long felt need to provide a device which is easy to use. The invention is especially convenient for people that want to purchase shoes without trying them on, and for people buying shoes for children. Also, the invention is especially helpful in self-service locations or locations with insufficient sales staff to help a person choose the correct size. In addition, the invention will be especially useful for a person seeking to buy a shoe for a child where the child's shoe size is not known, and where a person seeks to monitor a child's growth as related to the child's shoe size.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A visual shoe fit guide for a shoe comprising, in combination:

a shoe and a planar shaped tag associated with said shoe, the tag correlating to the size of the shoe to which the tag is associated;

a reference gauge printed on said tag at a proximal end spaced from said proximal end's edge of the tag, the reference gauge defining a reference location for placing a person's heel of a foot, wherein the reference gauge further corresponds to where the heel of the foot is when inside the shoe, therein accounting for the rake and curvature of the shoe around the heel of the person's foot;

a first reference mark printed on said tag toward the distal end of the tag, the first reference mark defining a first zone, which has sufficient width to allow all the toes of the foot to extend into said first zone in an overlying relationship and within which, at least the end of the longest toes should be when the heel is aligned with the reference gauge, to ensure a proper fit of the associated shoe on the foot; and a second reference mark printed on said tag distal from the first reference mark, the second reference mark defining a second zone corresponding to a clearance distance within the shoe to further ensure the proper fit of the shoe on the foot, wherein the visual determination of proper fit of the shoe is made by placing the tag against the bottom of the foot.

2. The visual shoe fit guide of claim 1, further comprising an outline printed on the tag corresponding with an overall heel to toe shape within the shoe.

3. The visual shoe fit guide of claim 2, further comprising:

a third reference mark printed on the tag, the third reference mark defining a third zone corresponding to a proper width fit within the shoe.

4. The visual shoe fit guide of claim 3, further comprising:

a fourth reference mark printed on the tag intermediate the reference gauge and the first reference mark, the fourth reference mark defining a fourth zone corresponding to where a ball of the foot should align for ensuring the proper fit of the shoe when the heel is placed in the reference gauge.

5. The visual shoe fit guide of claim 4, wherein the wherein the reference gauge, the first reference mark, the second reference mark, third reference mark, the fourth reference mark and the outline are printed on both sides of the tag, wherein one side of the tag represents a left shoe and an opposite side of the tag represents a right shoe.

6. The visual shoe fit guide of claim 5, wherein the wherein the reference gauge, the first reference mark, the second reference mark, third reference mark, the fourth reference mark and the outline are arranged to correspond to a predetermined size of a shoe.

7. The visual shoe fit guide of claim 5, wherein the tag has means for attaching said tag to the shoe.

8. The visual shoe fit guide of claim 3, wherein the reference gauge, the first reference mark, the second reference mark, third reference mark and the outline are printed on both sides of the tag, wherein one side of the tag represents a left shoe and an opposite side of the tag represents a right shoe.

9. The visual shoe fit guide of claim 8, wherein the reference gauge, the first reference mark, the second reference mark, the third reference mark and the outline are arranged to correspond to a predetermined size of a shoe.

10. The visual shoe fit guide of claim 2, wherein the reference gauge, the first reference mark, the second reference mark and the outline are printed on printed on both sides of the tag, wherein one side of the tag represents a left shoe and an opposite side of the tag represents a right shoe.

11. The visual shoe fit guide of claim 10, wherein the reference gauge, the first reference mark, the second reference mark and the outline are arranged to correspond to a predetermined size of a shoe.

12. The visual shoe fit guide of claim 1, wherein the tag is stored with the shoe to be sold.

13. A visual shoe fit guide for a shoe comprising, in combination:

a shoe and a planar shaped tag associated with said shoe, the tag correlating to the size of the shoe to which the tag is associated;

a reference gauge printed on said tag at a proximal spaced from said proximal end's edge of the tag, the reference gauge defining a reference location for placing a person's heel of a foot, wherein the reference gauge further corresponds to where the heel of the foot is when inside the shoe, therein accounting for the rake and curvature of the shoe around the heel of the person's foot; and a first reference mark printed on said tag toward the distal end of the tag, the first reference mark defining a first zone, which has sufficient width to allow all the toes of the foot to extend into said first zone in an overlying relationship and within which, at least the end of the longest toes should be when the heel is aligned with the reference gauge, to ensure a proper fit of the associated shoe on the foot, wherein the visual determination of proper fit of the shoe is made by placing the tag against the bottom of the foot.

14. The visual shoe fit guide according to claim 13, further comprising:

a second reference mark printed on said tag distal from the first reference mark, the second reference mark defining a second zone corresponding to a clearance distance within the shoe to further ensure the proper fit of the shoe on the foot.

15. The visual shoe fit guide according to claim 14, further comprising:

an outline printed on the tag corresponding with an overall heel to toe shape within the shoe.

16. The visual shoe fit guide according to claim 15, further comprising:

a third reference mark printed on the tag, the third reference mark defining a third zone corresponding to a proper width fit within the shoe.

17. The visual shoe fit guide according to claim 16, further comprising:

a fourth reference mark printed on the tag intermediate the reference gauge and the first reference mark, the fourth reference mark defining a fourth zone corresponding to where a ball of the foot should align for ensuring the proper fit of the shoe when the heel is placed in the reference gauge.

18. The visual shoe fit guide according to claim 17, wherein the reference gauge, the first reference mark, the second reference mark and the outline are printed on printed on both sides of the tag, wherein one side of the tag represents a left shoe and an opposite side of the tag represents a right shoe.

19. The visual shoe fit guide according to claim 18, wherein the reference gauge, the first reference mark, the second reference mark and the outline are arranged to correspond to a predetermined size of a shoe.

20. The visual shoe fit guide according to claim 17, wherein the wherein the reference gauge, the first reference mark, the second reference mark, third reference mark, the fourth reference mark and the outline are printed on both sides of the tag, wherein one side of the tag represents a left shoe and an opposite side of the tag represents a right shoe.

21. The visual shoe fit guide according to claim 20, wherein the wherein the reference gauge, the first reference mark, the second reference mark, third reference mark, the fourth reference mark and the outline are arranged to correspond to a predetermined size of a shoe.

22. The visual shoe fit guide according to claim 16, wherein the reference gauge, the first reference mark, the second reference mark, third reference mark and the outline are printed on both sides of the tag, wherein one side of the tag represents a left shoe and an opposite side of the tag represents a right shoe.

23. The visual shoe fit guide according to claim 22, wherein the reference gauge, the first reference mark, the second reference mark, the third reference mark and the outline are arranged to correspond to a predetermined size of a shoe.

24. The visual shoe fit guide according to claim 22, wherein the tag has means for attaching said tag to the shoe.

25. The visual shoe fit guide according to claim 13, further comprising:

an outline printed on the tag corresponding with an overall heel to toe shape within the shoe.

26. The visual shoe fit guide according to claim 13, wherein the tag is stored with the shoe to be sold.

* * * * *

UNITED STATES PATENT AND TRADEMARK OFFICE

CERTIFICATE OF CORRECTION

PATENT NO. : 6,651,349 B2
DATED : November 25, 2003
INVENTOR(S) : H. Kevin Coplon and Will St. Onge It is certified that error appears in the above-identified patent and that said Letters Patent is hereby corrected as shown below:

Title page,
Item [73], Assignee, replace "Ion Beam Applications S.A., Louvain-la-Neuve (BE)" with -- No Assignment was filed in this application --.
Item [74], *Attorney, Agent, or Firm*, replace "Merchant & Gould P.C." with -- Dennis G. LaPointe; Mason Law, P.A. --.

Column 8,
Line 66, replace "at a proximal spaced" with -- at a proximal end spaced --.

Signed and Sealed this

Eleventh Day of May, 2004

JON W. DUDAS
*Acting Director of the United States Patent and Trademark Office*